US006851135B1

(12) United States Patent
Chen

(10) Patent No.: US 6,851,135 B1
(45) Date of Patent: Feb. 8, 2005

(54) FOLDABLE SKELETON FOR PLAYPEN

(76) Inventor: Owen Chen, 284, Min Quan W. Rd., Taipei City (TW)

( * ) Notice: Subject to any disclaimer, the term of this patent is extended or adjusted under 35 U.S.C. 154(b) by 0 days.

(21) Appl. No.: 10/789,708

(22) Filed: Feb. 27, 2004

(51) Int. Cl.[7] ..... A47D 13/06
(52) U.S. Cl. ..... 5/99.1; 5/98.1
(58) Field of Search ..... 5/99.1, 98.1, 93.1, 5/97; 403/102

(56) References Cited

U.S. PATENT DOCUMENTS 6,473,919 B1 * 11/2002 Wang ..... 5/99.1
6,510,569 B1 * 1/2003 Hu ..... 5/99.1

* cited by examiner

*Primary Examiner*—Michael F. Trettel
*Assistant Examiner*—Fredrick Conley
(74) *Attorney, Agent, or Firm*—Alan D. Kamrath; Nikolai & Mersereau, P.A.

(57) ABSTRACT

A foldable skeleton for a playpen foldable skeleton includes an upper frame, four upright rods, and a bottom frame. The upper frame includes two pairs of first rods, two pairs of second rods, four joints, and four connecting seats. Each of the joints includes a main base, a press button, a cover, a locking block, an elastic member, and two linking blocks. The bottom frame includes four support seats, four bottom rods, two linking gears, a connecting base, a pull member, and an operation member. Thus, the teeth of the two linking gears mesh with each other, so that the two linking gears are rotated relative to each other in a synchronous manner, and the bottom rods are folded synchronously.

19 Claims, 13 Drawing Sheets

FOLDABLE SKELETON FOR PLAYPEN

BACKGROUND OF THE INVENTION

1. Field of the Invention

The present invention relates to a foldable skeleton, and more particularly to a foldable skeleton for a playpen.

2. Description of the Related Art

A conventional foldable skeleton for a playpen in accordance with the prior art comprises an upper frame, a bottom frame and four upright rods mounted between the upper frame and the bottom frame. The upper frame includes two pairs of longer rods, two pairs of shorter second rods, and four joints mounted between two adjacent longer rods and mounted between two adjacent shorter rods respectively. The bottom frame includes two pairs of bottom rods connected by a base. However, when the bottom frame is folded, the two pairs of bottom rods are not moved in a synchronous manner, thereby causing inconvenience to the user in folding the conventional skeleton.

SUMMARY OF THE INVENTION

The primary objective of the present invention is to provide a foldable skeleton for a playpen, wherein the skeleton is expanded and folded easily and conveniently.

Another objective of the present invention is to provide a foldable skeleton for a playpen, wherein the teeth of the two linking gears mesh with each other, so that the two linking gears are rotated relative to each other in a synchronous manner, and the bottom rods are folded synchronously.

In accordance with the present invention, there is provided a foldable skeleton, comprising an upper frame, four upright rods, and a bottom frame, wherein:

the upper frame includes two pairs of first rods, two pairs of second rods, four joints, and four connecting seats;

the joints are mounted between two adjacent first rods and mounted between two adjacent second rods respectively;

each of the joints includes a main base, a press button, a cover, a locking block, an elastic member, and two linking blocks;

the main base has a first side plate formed with a receiving hole and a second side plate formed with a cruciform slot;

each of the first rods has a first end pivotally mounted on an end of a respective one of the main base and a second end mounted on a respective one of the connecting seats;

each of the second rods has a first end pivotally mounted on an end of a respective one of the main base and a second end mounted on a respective one of the connecting seats;

the press button is movably mounted in the receiving hole of the second side plate of the main base;

the cover is secured on the second side plate of the main base and has an inside formed with a receiving recess;

the locking block is movably mounted in the cruciform slot of the main base and has a first portion formed with a mounting section secured on the press button to move therewith and a second portion formed with an action section that is movable into the receiving recess of the cover;

the elastic member is mounted on the mounting section of the locking block and is urged between the press button and the main base to press the press button to move outward relative to the cover;

each of the linking blocks has a first end mounted in the first end of each of the first rods or mounted in the first end of each of the second rods to pivot therewith and a second end detachably rested on the action section of the locking block, so that each of the linking blocks is fixed on the main base by the locking block;

each of the four upright rods has a first end mounted on a respective one of the connecting seats;

the bottom frame includes four support seats, four bottom rods, two linking gears, a connecting base, a pull member, and an operation member;

each of the support seats is mounted on a second end of a respective one of the upright rods and has a side formed with a pivot ear;

each of the bottom rods has a first end pivotally mounted on the pivot ear of a respective one of the support seats and a second end pivotally mounted on a respective one of the linking gears;

each of the linking gears has a first end formed with two spaced side plates and a receiving space located between the two side plates, each of the two side plates of each of the linking gears has a first side formed with a cutout and a second side formed with a plurality of teeth, the teeth of the two linking gears mesh with each other;

the connecting base is mounted on the linking gears to encompass the two linking gears;

the pull member is mounted on the linking gears to move the two linking gears and includes a combination section mounted in the receiving space of each of the linking gears and a top plate mounted on a top of the combination section, the combination section of the pull member is formed with a receiving slot, and the top plate of the pull member is formed with a rectangular slot communicating with the receiving slot; and the operation member is rotatably mounted on the pull member and has a bottom formed with a rectangular press block rotatably mounted in the receiving slot of the pull member and rested on the cutout of the two linking gears.

Further benefits and advantages of the present invention will become apparent after a careful reading of the detailed description with appropriate reference to the accompanying drawings.

DETAILED DESCRIPTION OF THE INVENTION

Figure 1:
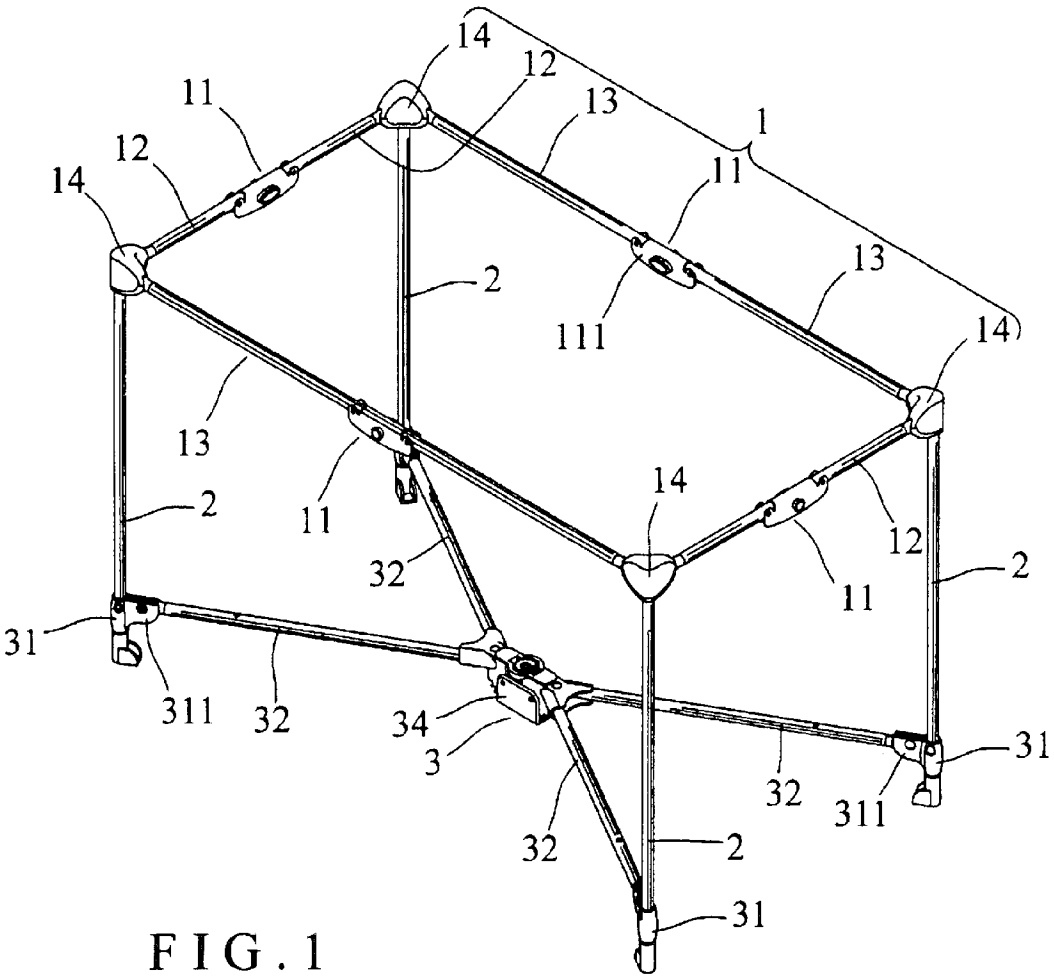
FIG. 1 is a perspective view of a foldable skeleton for a playpen in accordance with the preferred embodiment of the present invention.
Figure 2:
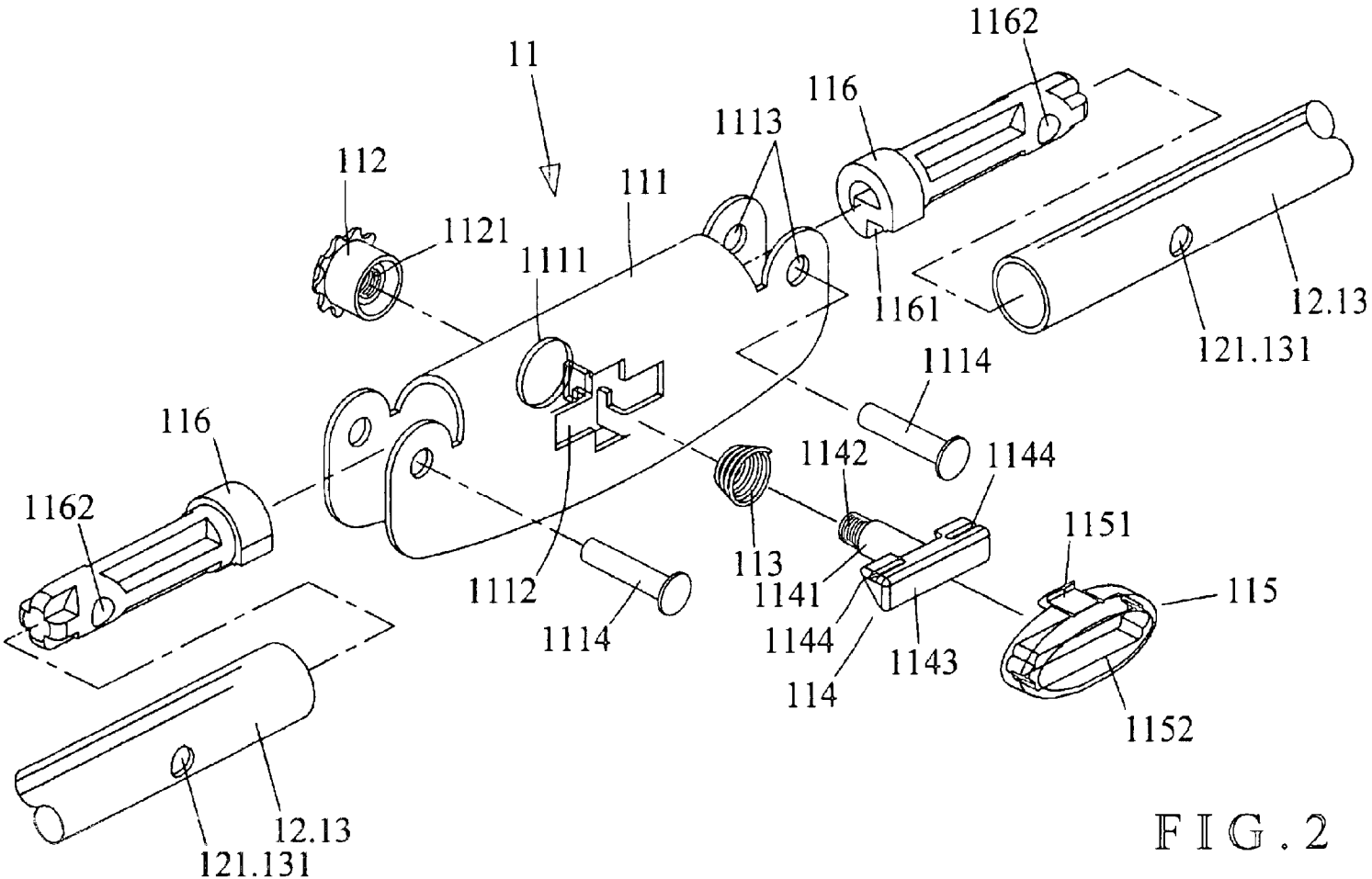
FIG. 2 is a partially exploded perspective view of the foldable skeleton as shown in FIG. 1.
Figure 3:
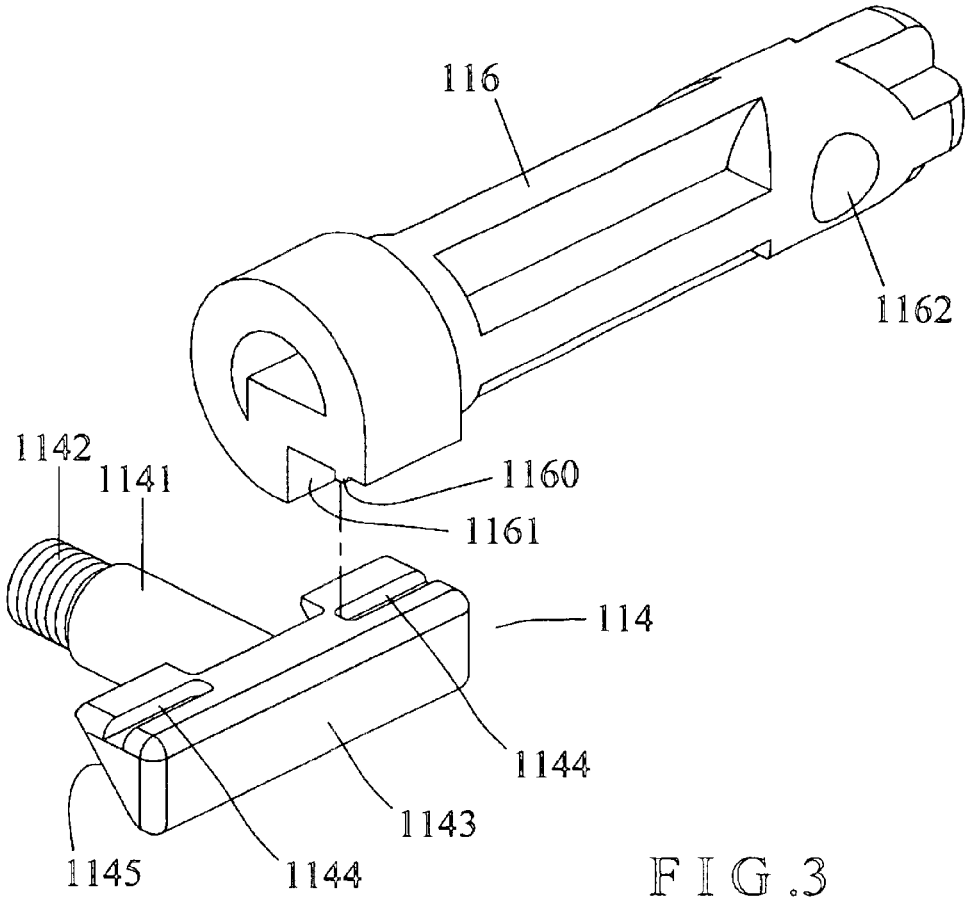
FIG. 3 is a partially enlarged view of the foldable skeleton as shown in FIG. 2.
Figure 4:
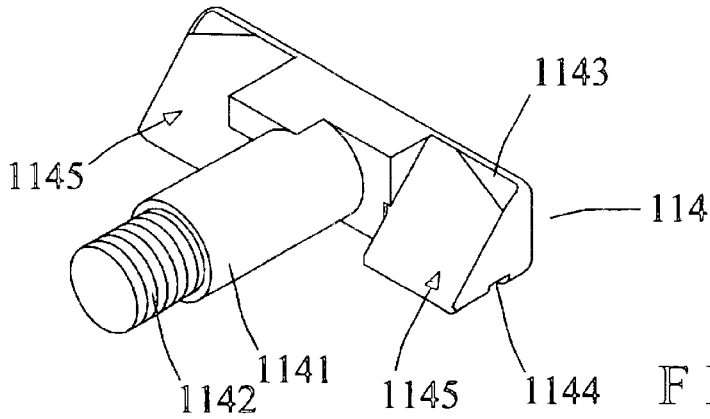
FIG. 4 is a partially enlarged view of the foldable skeleton as shown in FIG. 2.

Referring to the drawings and initially to FIG. 1, a foldable skeleton for a playpen in accordance with the preferred embodiment of the present invention comprises an upper frame 1, four upright rods 2, and a bottom frame 3.

As shown in FIGS. 1–11, the upper frame 1 includes two pairs of first rods 13, two pairs of second rods 12, four joints 11, and four connecting seats 14.

The joints 11 are mounted between two adjacent first rods 13 and mounted between two adjacent second rods 12 respectively. Each of the joints 11 includes a main base 111, a press button 112, a cover 115, a locking block 114, an elastic member 113, and two linking blocks 116.

The main base 111 is substantially U-shaped and has a first side plate formed with a receiving hole 1111 and a second side plate formed with a cruciform slot 1112.

Each of the first rods 13 has a first end pivotally mounted on an end of a respective one of the main base 111 and a second end mounted on a respective one of the connecting seats 14 as shown in FIG. 1, and each of the second rods 12 has a first end pivotally mounted on an end of a respective one of the main base 111 and a second end mounted on a respective one of the connecting seats 14 as shown in FIG. 1.

The press button 112 is movably mounted in the receiving hole 1111 of the second side plate of the main base 111 and has an inside formed with a screw bore 1121.

Figure 7:
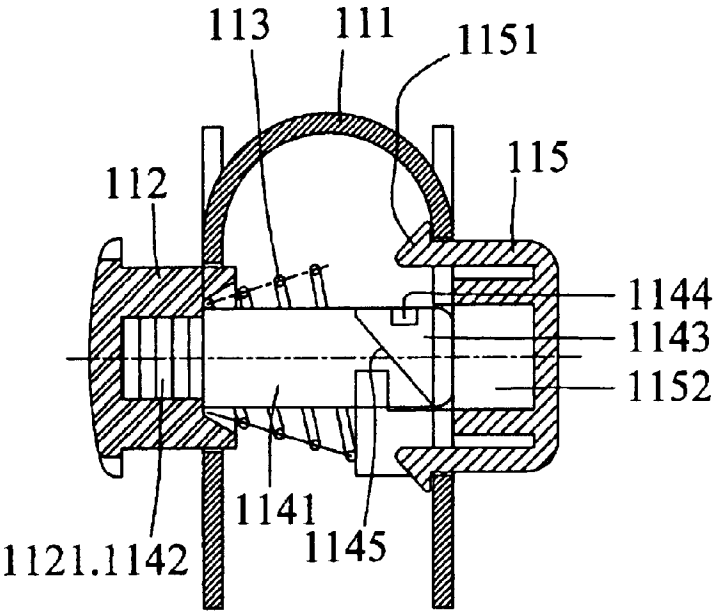
FIG. 7 is a cross-sectional view of the foldable skeleton taken along line 7—7 as shown in FIG. 5.

The cover 115 is secured on the second side plate of the main base 111 and has an inside formed with a receiving recess 1152. The cover 115 has a periphery formed with two opposite locking snaps 1151 each extended through the cruciform slot 1112 of the second side plate of the main base 111 and locked on the second side plate of the main base 111 as shown in FIG. 7.

The locking block 114 is substantially T-shaped and is movably mounted in the cruciform slot 1112 of the main base 111. The locking block 114 has a first portion formed with a mounting section 1141 secured on the press button 112 to move therewith and a second portion formed with an action section 1143 that is movable into the receiving recess 1152 of the cover 115. The mounting section 1141 of the locking block 114 has a distal end formed with an outer thread 1142 screwed into the screw bore 1121 of the press button 112. The action section 1143 of the locking block 114 has a first side formed with two spaced locking grooves 1144 and a second side formed with two spaced ramps 1145.

The elastic member 113 is mounted on the mounting section 1141 of the locking block 114 and is urged between the press button 112 and the main base 111 to press the press button 112 to move outward relative to the cover 115.

Each of the linking blocks 116 has a first end mounted in the first end of each of the first rods 13 or mounted in the first end of each of the second rods 12 to pivot therewith and a second end detachably rested on the action section 1143 of the locking block 114, so that each of the linking blocks 116 is fixed on the main base 111 by the locking block 114.

The first end of each of the first rods 13 is formed with a through hole 131, the first end of each: of the second rods 12 is formed with a through hole 121, each of the two side plates of the main base 1111 has two ends each formed with a through hole 1113, the first end of each of the linking blocks 116 is formed with a through hole 1162, and each of the joints 11 further includes two pivot shafts 1114 each extended through the respective through hole 1113 of the main base 111, the through hole 131 of the respective first rod 13 or the through hole 121 of the respective second rod 12, and the through hole 1162 of the respective linking block 116.

In addition, the second end of each of the linking blocks 116 is formed with a substantially L-shaped cutout 1161 rested on the action section 1143 of the locking block 114. The cutout 1161 of each of the linking blocks 116 is formed with a locking rib 1160 detachably locked in the respective locking groove 1144 of the action section 1143 of the locking block 114.

Each of the four upright rods 2 has a first end mounted on a respective one of the connecting seats 14 as shown in FIG. 1.

Figures 12, 13:
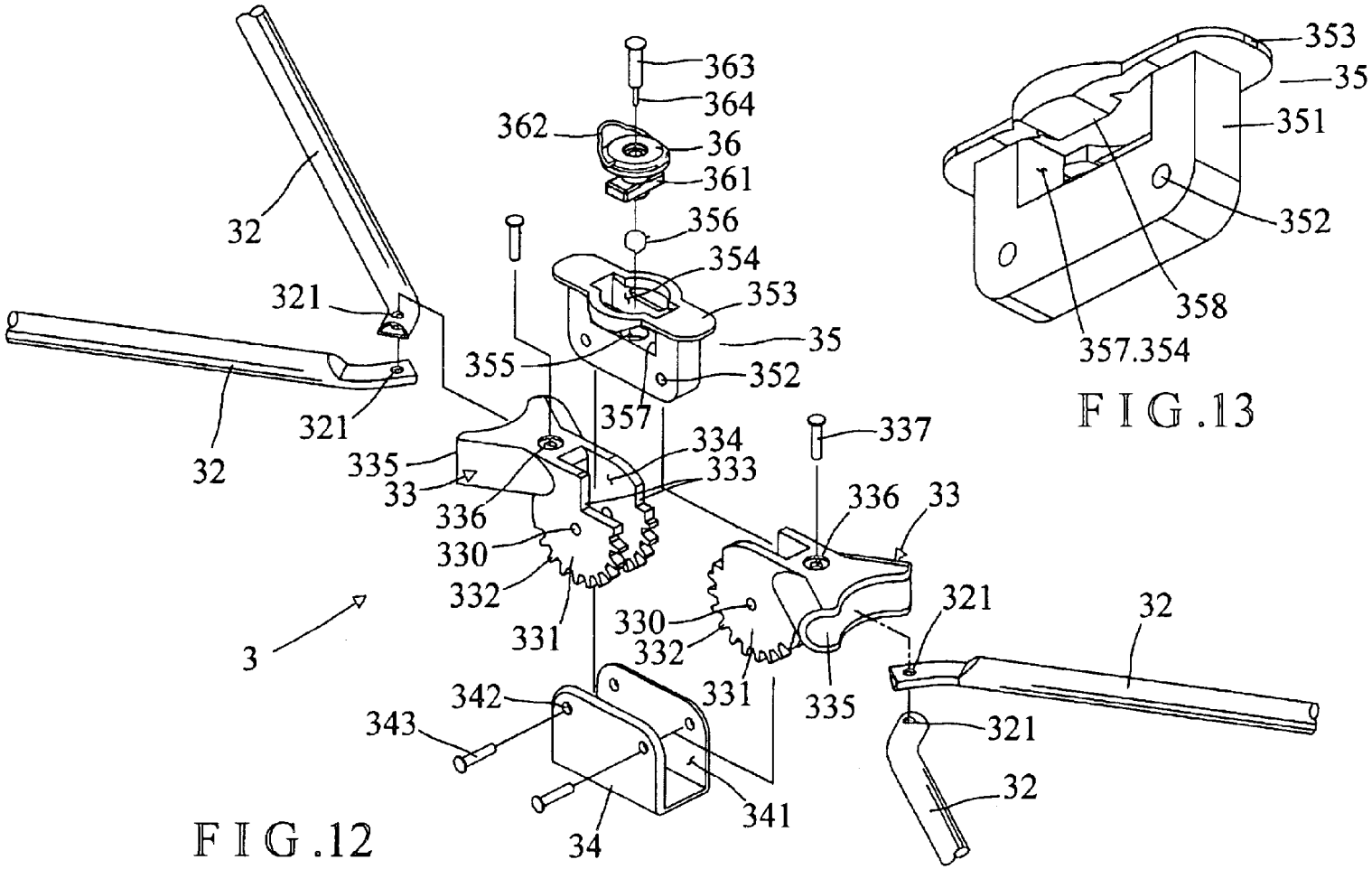
FIG. 12 is a partially exploded perspective view of the foldable skeleton as shown in FIG. 1.
FIG. 13 is a partially enlarged view of the foldable skeleton as shown in FIG. 12.
Figure 14:
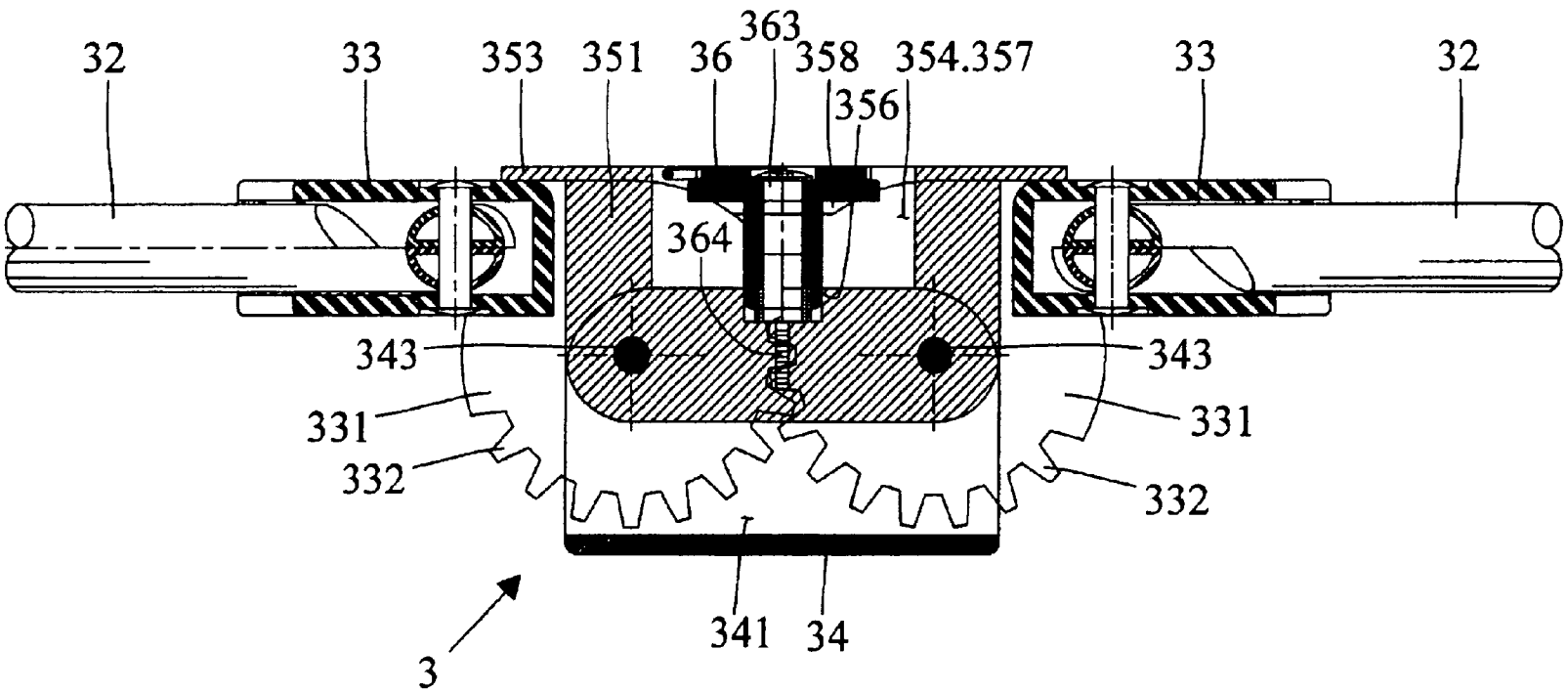
FIG. 14 is a front plan cross-sectional assembly view of the foldable skeleton as shown in FIG. 12.

Referring to FIGS. 12–14 with reference to FIG. 1, the bottom frame 3 includes four support seats 31, four bottom rods 32, two linking gears 33, a connecting base 34, a pull member 35, and an operation member 36.

Each of the support seats 31 is mounted on a second end of a respective one of the upright rods 2 as shown in FIG. 1 and has a side formed with a pivot ear 311.

Each of the bottom rods 32 has a first end pivotally mounted on the pivot ear 311 of a respective one of the support seats 31 and a second end pivotally mounted on a respective one of the linking gears 33.

Each of the linking gears 33 has a first end formed with two spaced side plates 331 and a receiving space 334 located between the two side plates 331. Each of the two side plates 331 of each of the linking gears 33 has a first side formed with a substantially L-shaped cutout 333 and a second side formed with a plurality of teeth 332. The teeth 332 of the two linking gears 33 mesh with each other so that the two linking gears 33 are rotated synchronously. Each of the linking gears 33 has a second end formed with a hollow mounting portion 335 for mounting the bottom rods 32. The mounting portion 335 of each of the linking gears 33 is formed with a through hole 336, the first end of each of the bottom rods 32 is formed with a through hole 321, and the bottom frame 3 further includes two pivot shafts 337 each extended through the through hole 336 of a respective one of the linking gears 33 and the through hole 321 of two adjacent bottom rods 32.

The connecting base 34 is substantially U-shaped and is mounted on the linking gears 33 to encompass the two linking gears 33.

The pull member 35 is mounted on the linking gears 33 to move the two linking gears 33. The pull member 35 includes a substantially U-shaped combination section 351 mounted in the receiving space 334 of each of the linking gears 33 and a top plate 353 mounted on a top of the combination section 351. The combination section 351 of the pull member 35 is formed with a receiving slot 357, and the top plate 353 of the pull member 35 is formed with a rectangular slot 354 communicating with the receiving slot 357.

Each of the two side plates 331 of each of the linking gears 33 has a center formed with a through hole 330, the connecting base 34 has two side plates each having two ends each formed with a through hole 342, the combination section 351 of the pull member 35 has two ends each formed with a through hole 352, and the bottom frame 3 further includes two pivot shafts 337 each extended through the respective through hole 342 of the connecting base 34, the through hole 330 of a respective one of the linking gears 33 and the respective through hole 352 of the combination section 351 of the pull member 35.

The operation member 36 is rotatably mounted on the pull member 35 and has a bottom formed with a rectangular press block 361 rotatably mounted in the receiving slot 357 of the pull member 35 and rested on the cutout 333 of the two linking gears 33. The press block 361 of the operation member 36 is rotatable to align with the rectangular slot 354 of the pull member 35. The top plate 353 of the pull member 35 is formed with an extension 358 located above the receiving slot 357 and rested on the press block 361 of the operation member 36.

The bottom frame 3 further includes a handle 362 pivotally mounted on the operation member 36 for rotating the operation member 36, a positioning shaft 363 extended through the operation member 36 and fixed on the combination section 351 of the pull member 35, and a compression member 356 mounted on positioning shaft 363 and urged between the press block 361 of the operation member 36 and the combination section 351 of the pull member 35. The receiving slot 357 of the pull member 35 has a bottom formed with a screw bore 355, and the positioning shaft 363 has a distal end formed with an outer thread 364 screwed into the screw bore 355 of the pull member 35.

Figure 15:
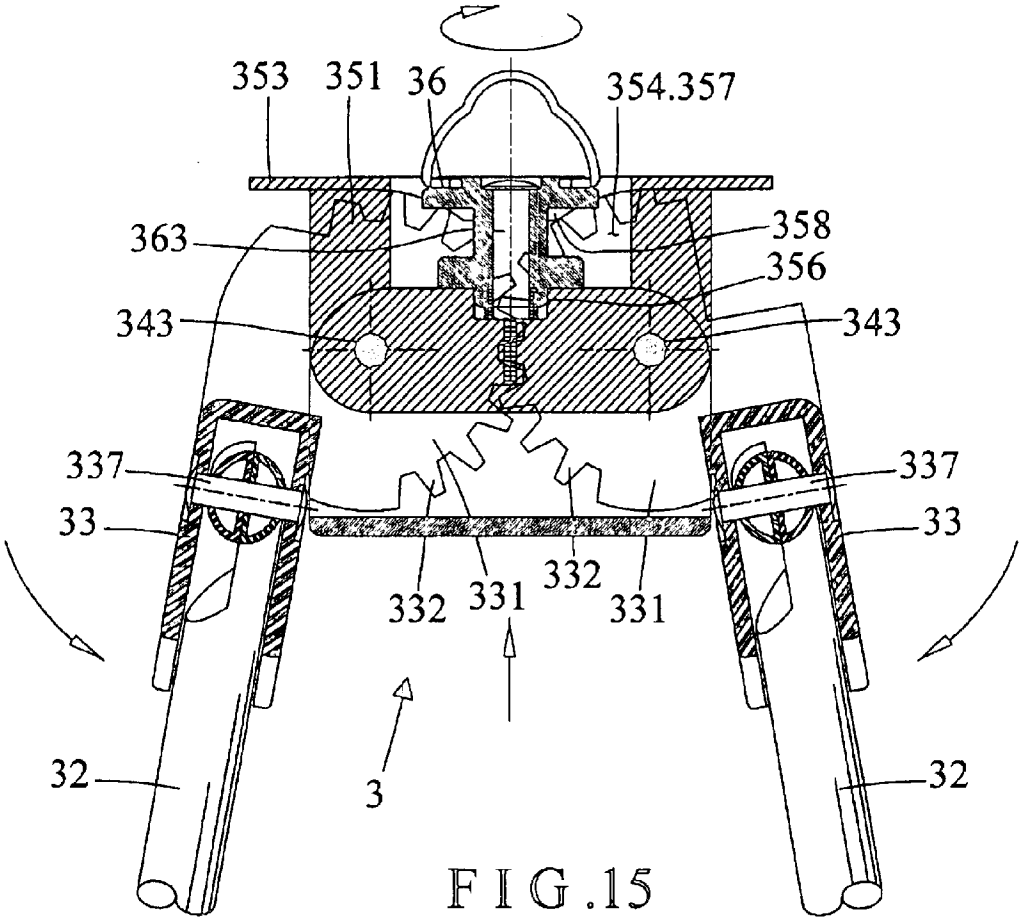
FIG. 15 is a schematic operational view of the foldable skeleton as shown in FIG. 14.
Figure 16:
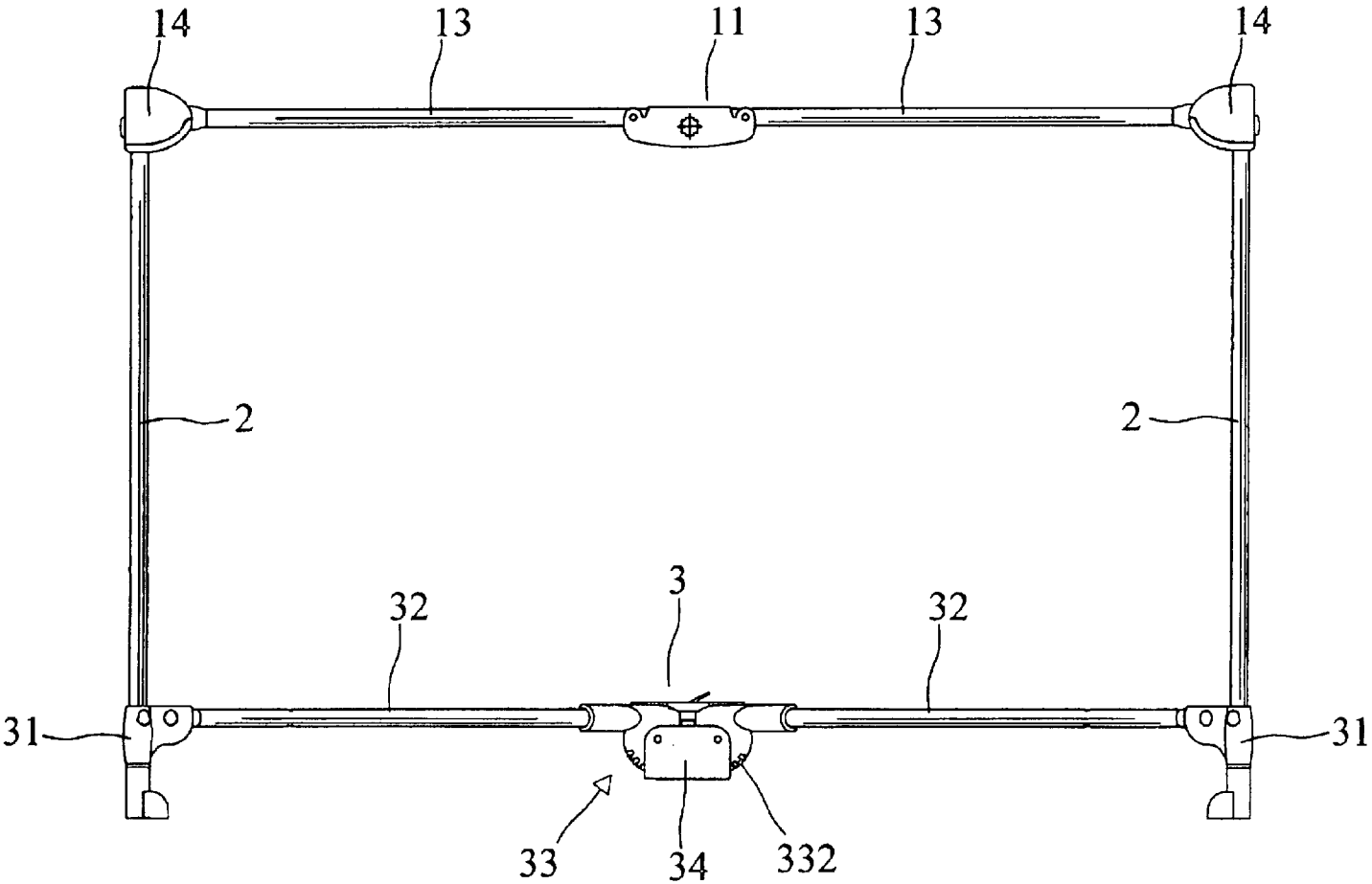
FIG. 16 is a plan view of the foldable skeleton as shown in FIG. 1.

In operation, referring to FIGS. 1–18, the press block 361 of the operation member 36 is initially rested on the cutout 333 of the two linking gears 33, so that the two linking gears 33 are positioned by the press block 361 of the operation member 36 as shown in FIG. 14. Then, the handle 362 is rotated to rotate the operation member 36, so that the press block 361 of the operation member 36 is rotated to align with the rectangular slot 354 of the pull member 35. Then, the press block 361 of the operation member 36 is pushed by the restoring force of the compression member 356 and is inserted into the rectangular slot 354 of the pull member 35, thereby detaching the press block 361 of the operation member 36 from the cutout 333 of the two linking gears 33, so that the two linking gears 33 are released and can be rotated freely. Then, the handle 362 is pulled upward to lift the operation member 36 which lifts the pull member 35 which lifts the two linking gears 33, so that the bottom frame 3 is moved upward and the bottom rods 32 are pivoted to move toward each other as shown in FIG. 15, thereby folding the bottom frame 3 and the bottom rods 32. At this time, the teeth 332 of the two linking gears 33 mesh with each other, so that the two linking gears 33 are rotated relative to each other in a synchronous manner, and the bottom rods 32 are folded synchronously.

Figure 5:
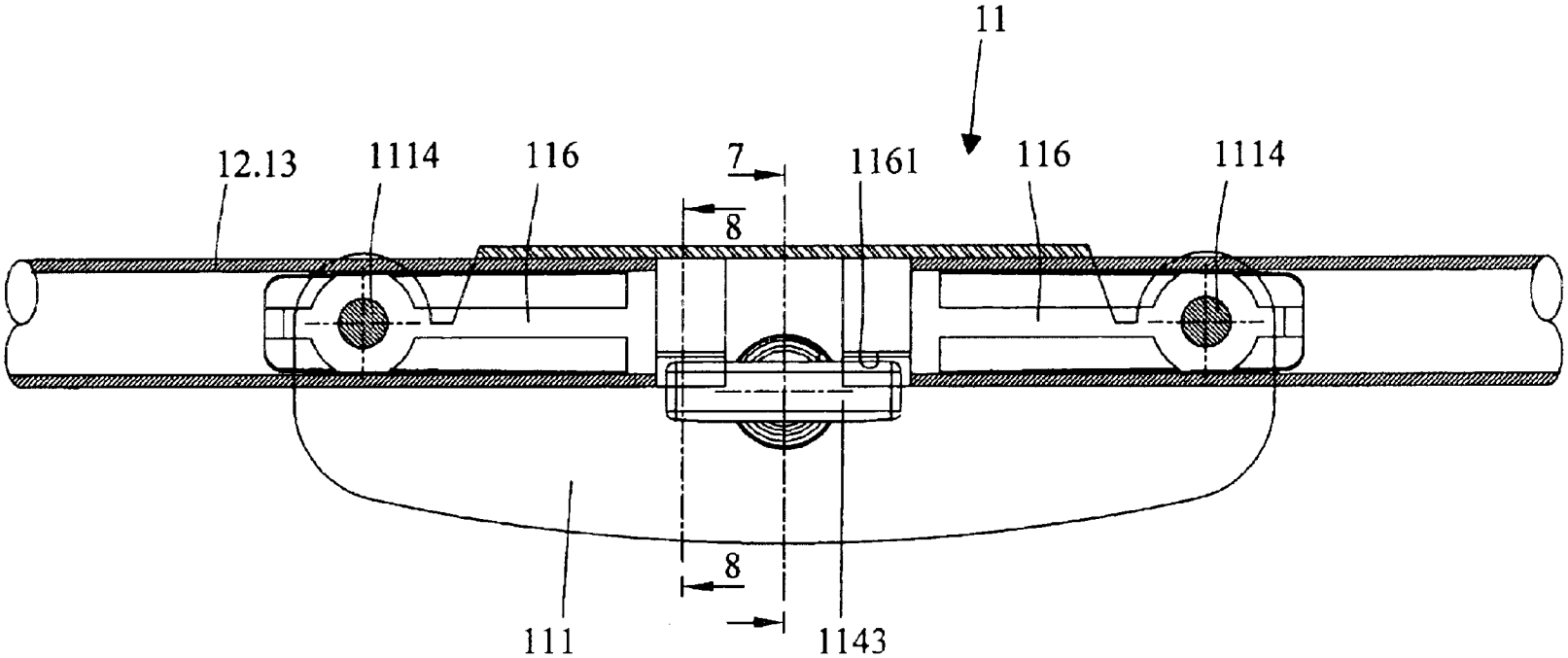
FIG. 5 is a front plan cross-sectional assembly view of the foldable skeleton as shown in FIG. 2.
Figure 6:
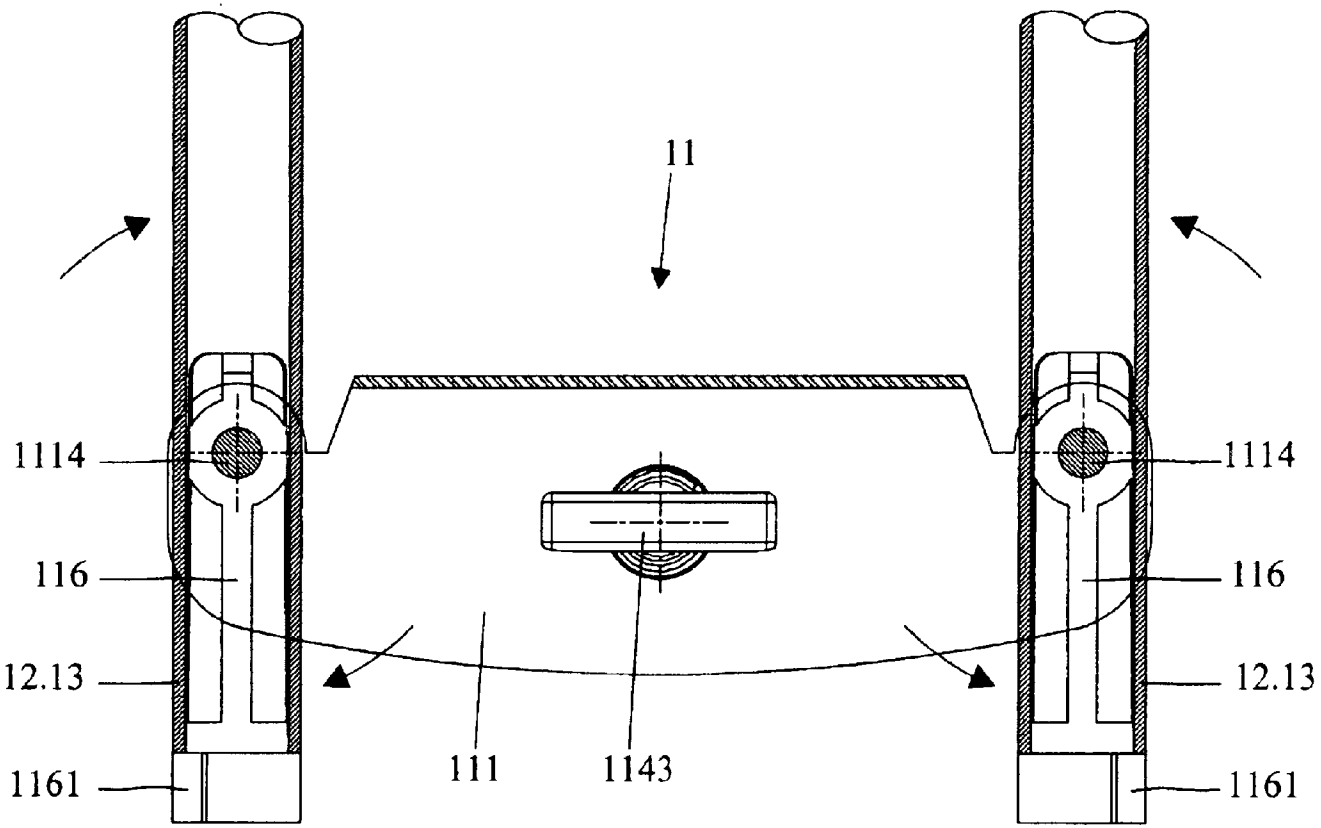
FIG. 6 is a schematic operational view of the foldable skeleton as shown in FIG. 5.
Figure 9:
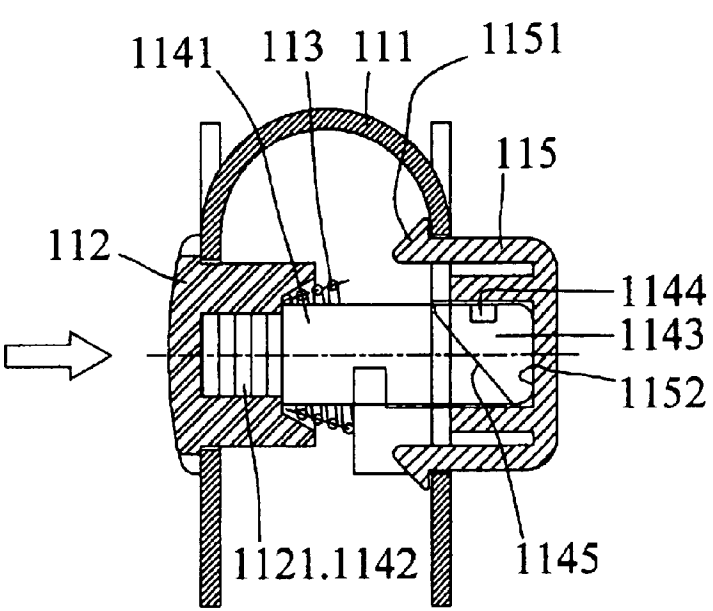
FIG. 9 is a schematic operational view of the foldable skeleton as shown in FIG. 7.

Subsequently, each of the joints 11 is moved upward to detach the locking rib 1160 of each of the linking blocks 116 from the respective locking groove 1144 of the locking block 114, so that the locking block 114 is movable freely. Then, as shown in FIGS. 7–10, the press button 112 is pressed to move toward the cover 115, so that the action section 1143 of the locking block 114 is moved to detach from the cutout 1161 of each of the linking blocks 116 and is inserted into the receiving recess 1152 of the cover 115, thereby releasing each of the linking blocks 116 from the locking block 114, such that each of the linking blocks 116 and the respective first rod 13 or the respective second rod 12 are pivoted freely. Then, as shown in FIGS. 5 and 6, each of the joints 11 is pressed to move downward, so that the first rods 13 are pivoted toward each other and the second rods 12 are pivoted toward each other, thereby folding the upper frame 1.

Figure 18:
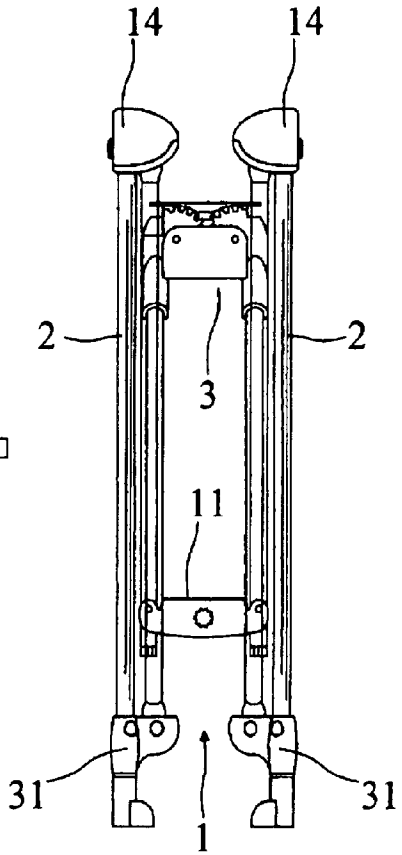
FIG. 18 is a side plan view of the foldable skeleton as shown in FIG. 17.
Figure 17:
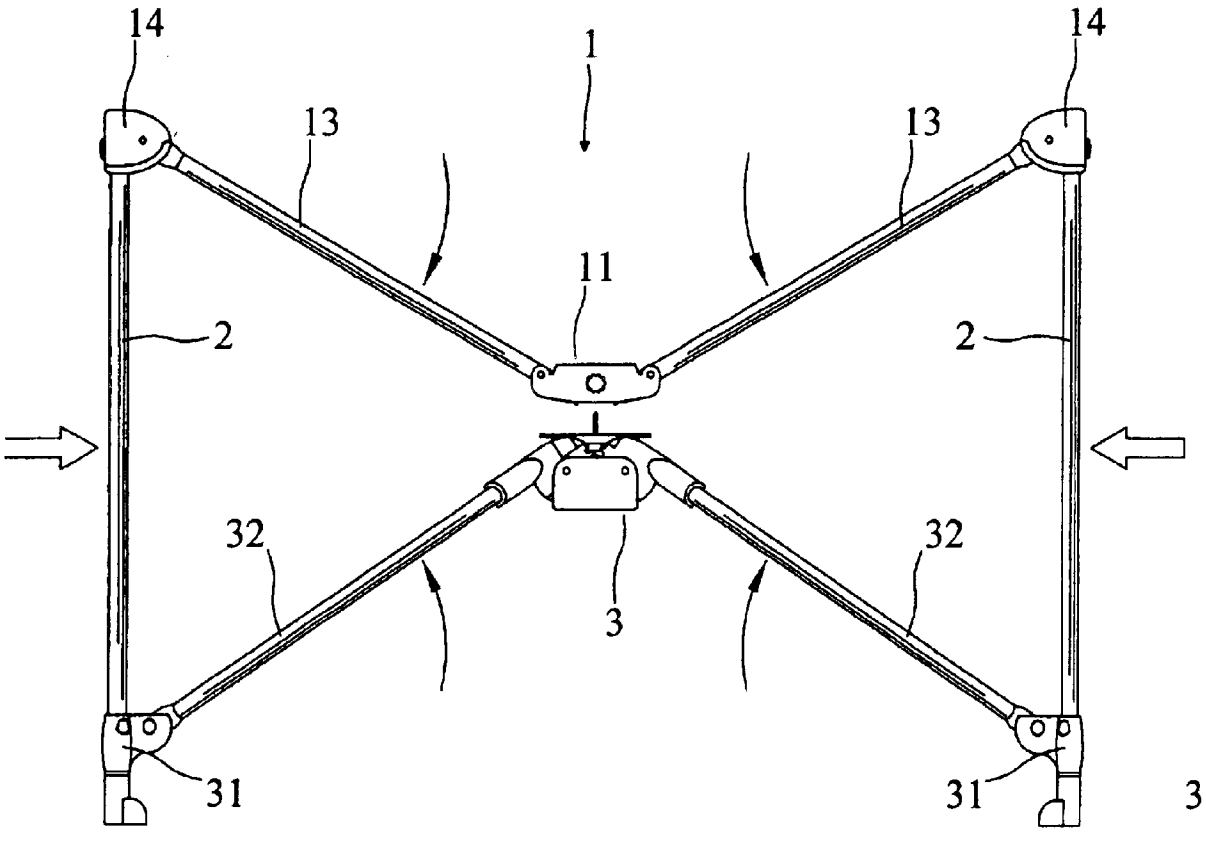
FIG. 17 is a schematic operational view of the foldable skeleton as shown in FIG. 16.

Thus, the upper frame 1, the four upright rods 2, and the bottom frame 3 are folded, so that the skeleton is folded as shown in FIGS. 17 and 18, thereby folding the playpen.

Figure 10:
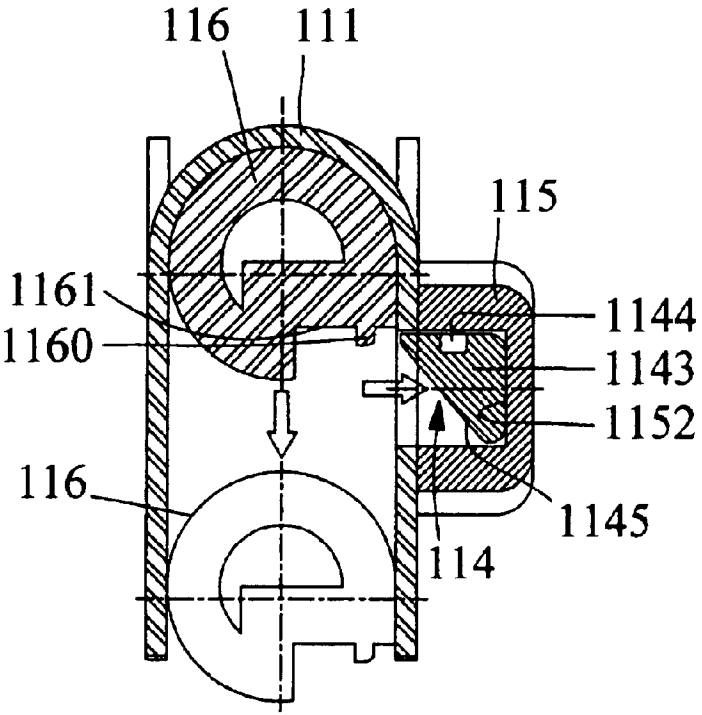
FIG. 10 is a schematic operational view of the foldable skeleton as shown in FIG. 8.
Figure 8:
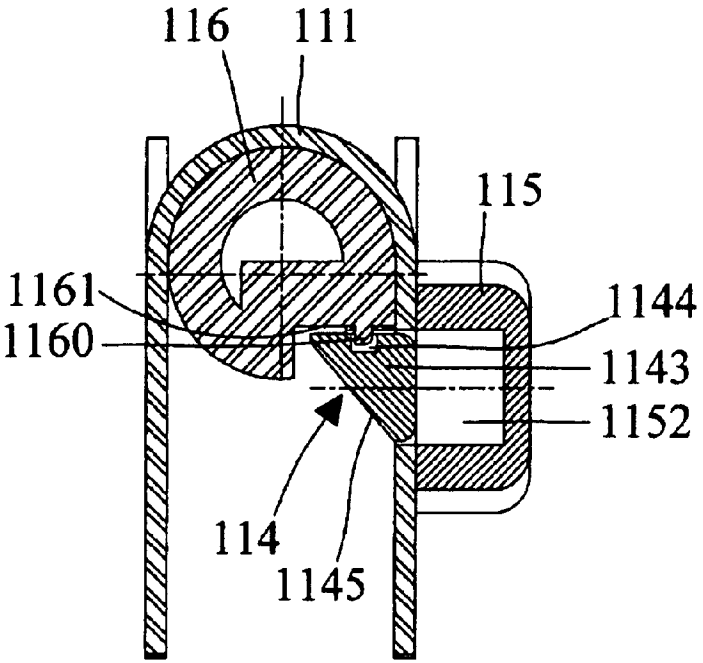
FIG. 8 is a cross-sectional view of the foldable skeleton taken along line 8—8 as shown in FIG. 5.
Figure 11:
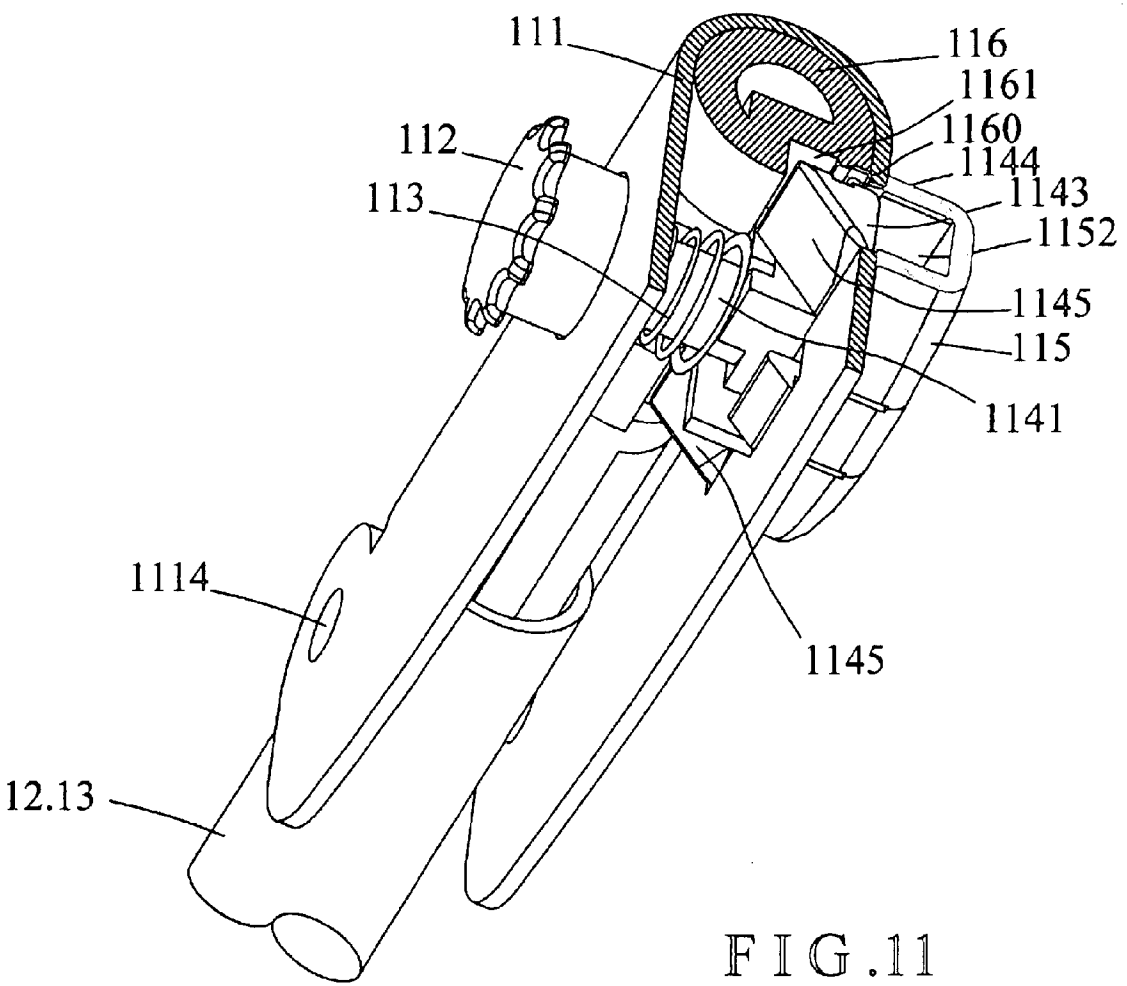
FIG. 11 is a cross-sectional perspective assembly view of the foldable skeleton as shown in FIG. 2.

It is noted that, after each of the linking blocks 116 passes the action section 1143 of the locking block 114 as shown in FIG. 10, the locking block 114 is returned to the original position as shown in FIG. 8 by the restoring force of the elastic member 113. In addition, each of the linking blocks 116 is returned to the original locked position by guidance of the two spaced ramps 1145 of the action section 1143 of the locking block 114 as shown in FIGS. 8 and 10.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A foldable skeleton, comprising an upper frame, four upright rods, and a bottom frame, wherein:

the upper frame includes two pairs of first rods, two pairs of second rods, four joints, and four connecting seats;

the joints are mounted between two adjacent first rods and mounted between two adjacent second rods respectively;

each of the joints includes a main base, a press button, a cover, a locking block, an elastic member, and two linking blocks;

the main base has a first side plate formed with a receiving hole and a second side plate formed with a cruciform slot;

each of the first rods has a first end pivotally mounted on an end of a respective one of the main base and a second end mounted on a respective one of the connecting seats;

each of the second rods has a first end pivotally mounted on an end of a respective one of the main base and a second end mounted on a respective one of the connecting seats;

the press button is movably mounted in the receiving hole of the second side plate of the main base;

the cover is secured on the second side plate of the main base and has an inside formed with a receiving recess;

the locking block is movably mounted in the cruciform slot of the main base and has a first portion formed with a mounting section secured on the press button to move therewith and a second portion formed with an action section that is movable into the receiving recess of the cover;

the elastic member is mounted on the mounting section of the locking block and is urged between the press button and the main base to press the press button to move outward relative to the cover;

each of the linking blocks has a first end mounted in the first end of each of the first rods or mounted in the first end of each of the second rods to pivot therewith and a second end detachably rested on the action section of the locking block, so that each of the linking blocks is fixed on the main base by the locking block;

each of the four upright rods has a first end mounted on a respective one of the connecting seats;

the bottom frame includes four support seats, four bottom rods, two linking gears, a connecting base, a pull member, and an operation member;

each of the support seats is mounted on a second end of a respective one of the upright rods and has a side formed with a pivot ear;

each of the bottom rods has a first end pivotally mounted on the pivot ear of a respective one of the support seats and a second end pivotally mounted on a respective one of the linking gears;

each of the linking gears has a first end formed with two spaced side plates and a receiving space located between the two side plates, each of the two side plates of each of the linking gears has a first side formed with a cutout and a second side formed with a plurality of teeth, the teeth of the two linking gears mesh with each other;

the connecting base is mounted on the linking gears to encompass the two linking gears;

the pull member is mounted on the linking gears to move the two linking gears and includes a combination section mounted in the receiving space of each of the linking gears and a top plate mounted on a top of the combination section, the combination section of the pull member is formed with a receiving slot, and the top plate of the pull member is formed with a rectangular slot communicating with the receiving slot; and the operation member is rotatably mounted on the pull member and has a bottom formed with a rectangular press block rotatably mounted in the receiving slot of the pull member and rested on the cutout of the two linking gears.

2. The foldable skeleton in accordance with claim 1, wherein the main base is substantially U-shaped.

3. The foldable skeleton in accordance with claim 1, wherein the cover has a periphery formed with two opposite locking snaps each extended through the cruciform slot of the second side plate of the main base and locked on the second side plate of the main base.

4. The foldable skeleton in accordance with claim 1, wherein the locking block is substantially T-shaped.

5. The foldable skeleton in accordance with claim 1, wherein the press button has an inside formed with a screw bore, and the mounting section of the locking block has a distal end formed with an outer thread screwed into the screw bore of the press button.

6. The foldable skeleton in accordance with claim 1, wherein the first end of each of the first rods is formed with a through hole, the first end of each of the second rods is formed with a through hole, each of the two side plates of the main base has two ends each formed with a through hole, the first end of each of the linking blocks is formed with a through hole, and each of the joints further includes two pivot shafts each extended through the respective through hole of the main base, the through hole of the respective first rod or the through hole of the respective second rod, and the through hole of the respective linking block.

7. The foldable skeleton in accordance with claim 1, wherein the second end of each of the linking blocks is formed with a substantially L-shaped cutout rested on the action section of the locking block.

8. The foldable skeleton in accordance with claim 7, wherein the action section of the locking block has a first side formed with two spaced locking grooves and a second side formed with two spaced ramps, and the cutout of each of the linking blocks is formed with a locking rib detachably locked in the respective locking groove of the action section of the locking block.

9. The foldable skeleton in accordance with claim 1, wherein each of the linking gears has a second end formed with a hollow mounting portion for mounting the bottom rods.

10. The foldable skeleton in accordance with claim 9, wherein the mounting portion of each of the linking gears is formed with a through hole, the first end of each of the bottom rods is formed with a through hole, and the bottom frame further includes two pivot shafts each extended through the through hole of a respective one of the linking gears and the through hole of two adjacent bottom rods.

11. The foldable skeleton in accordance with claim 1, wherein the connecting base is substantially U-shaped.

12. The foldable skeleton in accordance with claim 1, wherein the combination section of the pull member is substantially U-shaped.

13. The foldable skeleton in accordance with claim 1, wherein each of the two side plates of each of the linking gears has a center formed with a through hole, the connecting base has two side plates each having two ends each formed with a through hole, the combination section of the pull member has two ends each formed with a through hole, and the bottom frame further includes two pivot shafts each extended through the respective through hole of the connecting base, the through hole of a respective one of the linking gears and the respective through hole of the combination section of the pull member.

14. The foldable skeleton in accordance with claim 1, wherein the press block of the operation member is rotatable to align with the rectangular slot of the pull member.

15. The foldable skeleton in accordance with claim 1, wherein the top plate of the pull member is formed with an extension located above the receiving slot and rested on the press block of the operation member.

16. The foldable skeleton in accordance with claim 1, wherein the bottom frame further includes a handle pivotally mounted on the operation member for rotating the operation member.

17. The foldable skeleton in accordance with claim 1, wherein the bottom frame further includes a positioning shaft extended through the operation member and fixed on the combination section of the pull member.

18. The foldable skeleton in accordance with claim 17, wherein the bottom frame further includes a compression member mounted on positioning shaft and urged between the press block of the operation member and the combination section of the pull member.

19. The foldable skeleton in accordance with claim 17, wherein the receiving slot of the pull member has a bottom formed with a screw bore, and the positioning shaft has a distal end formed with an outer thread screwed into the screw bore of the pull member.

* * * * *